US006302634B1

(12) United States Patent
Grenader

(10) Patent No.: US 6,302,634 B1
(45) Date of Patent: Oct. 16, 2001

(54) MULTI-TIER PARKING LOT FOR VEHICLES

(76) Inventor: Michael Grenader, 50/15, Hativat Carmeli St., Haifa 32629 (IL)

( * ) Notice: Subject to any disclaimer, the term of this patent is extended or adjusted under 35 U.S.C. 154(b) by 0 days.

(21) Appl. No.: 09/271,324

(22) Filed: Mar. 18, 1999

Related U.S. Application Data

(60) Provisional application No. 60/078,496, filed on Mar. 18, 1998.

(51) Int. Cl.[7] ..... E04H 6/28

(52) U.S. Cl. ..... 414/240; 414/241; 414/253; 414/261

(58) Field of Search ..... 414/240, 241, 414/239, 264, 234, 261, 262, 259, 253

(56) References Cited

U.S. PATENT DOCUMENTS

| | | | | |
|---|---|---|---|---|
| 1,919,269 | * | 7/1933 | Becker | 414/262 X |
| 2,755,941 | * | 7/1956 | Orr | 414/262 |
| 2,816,624 | * | 12/1957 | Asheim et al. | 414/240 X |
| 3,217,905 | * | 11/1965 | Frangos | 414/239 |
| 3,395,815 | * | 8/1968 | Johnson | 414/240 |
| 3,499,553 | * | 3/1970 | Stienen | 414/239 |
| 3,680,718 | * | 8/1972 | Miyaehi | 414/239 |
| 3,896,955 | * | 7/1975 | Collins et al. | 414/262 X |

FOREIGN PATENT DOCUMENTS

| | | | | |
|---|---|---|---|---|
| 403221671 | * | 9/1991 | (JP) | 414/240 |
| 404323474 | * | 11/1992 | (JP) | 414/234 |
| 112381 | * | 2/1968 | (NO) | 414/240 |
| 413328 | * | 12/1966 | (SE) | 414/239 |

* cited by examiner

*Primary Examiner*—Steven A. Bratlie
(74) *Attorney, Agent, or Firm*—Blank Rome Comiscky & McCauley LLP

(57) ABSTRACT

The multitier facility for vehicle parking according to this invention comprises a main parking platform located on each tier, and an intertier elevator for delivering a vehicle to a required tier. The elevator has a rectangular-shaped load-receiving platform, a facility for horizontal movements of vehicles with the aim of placing them on the parking platforms and removing from them. Also included is a device for changing the direction of these movements.

7 Claims, 2 Drawing Sheets

MULTI-TIER PARKING LOT FOR VEHICLES

This application claims priority of U.S. Provisional Application Serial No. 60/078,496, filed Mar. 18, 1998 and is hereby incorporated by reference in its entirety.

BACKGROUND OF THE INVENTION

This invention relates to multitier parking lots for vehicles, in particular, to parking lots with mechanized means for movement of vehicles.

There is a well known multitier parking lot which contains rectangular elongated shaped parking platforms located on each tier an intertier elevator for delivering a vehicle to a required tier. The elevator is provided with a load-receiving platform having the same size as one parking platform, facility for horizontal movement of vehicles with the aim of placing them on the parking platforms and removing from them and a facility for changing the direction of these movements, which is accomplished in the form of a turntable. The parking platforms adjoin the turntable with their lesser sides and are oriented in radial direction relative to its center.

However, the above-described facility does not ensure sufficient efficiency of area utilization for parking due to great losses of the area (about 50%) both in the zones between adjacent parking platforms and on the turntable itself. The remaining unutilized area consists of scattered small sections, unfit for using for placing vehicles on them. The insufficient efficiency in using the area in such facilities makes such systems uneconomical in production and in the course of utilization.

OBJECTS AND SUMMARY OF THE INVENTION

It is a primary object of the present invention to create a multitier facility for vehicle parking wherein a load-receiving platform and parking platforms would have such shape and such relative dimensions and would be placed relative to one another in such a way, that would raise the efficiency of using the facility area and, in so doing, make it more economical in production and in the course of utilization.

This objective is carried out by providing a multitier facility for vehicle parking comprising main parking platforms located on each tier, an intertier elevator for delivering a vehicle to a required tier, this elevator having a rectangular-shaped load-receiving platform, a facility for horizontal movements of vehicles with the aim of placing them on the parking platforms and removing from them, and a facility for changing the direction of these movements. Preferably, each parking platform has a rectangular elongated shape. The main parking platforms adjoin at last two adjacent sides of load-receiving platform from inter-perpendicular directions, and the load-receiving platform has such dimensions, that at least in one of the positions of the load-receiving platform, its sides coincide over its entire length with the sides of the said main parking platforms adjoining the load-receiving platform.

BRIEF DESCRIPTION OF THE DRAWINGS

The essence of the invention will now be explained with reference to the drawings in which.

DETAILED DESCRIPTION OF THE PREFERRED EMBODIMENTS

Figure 1:
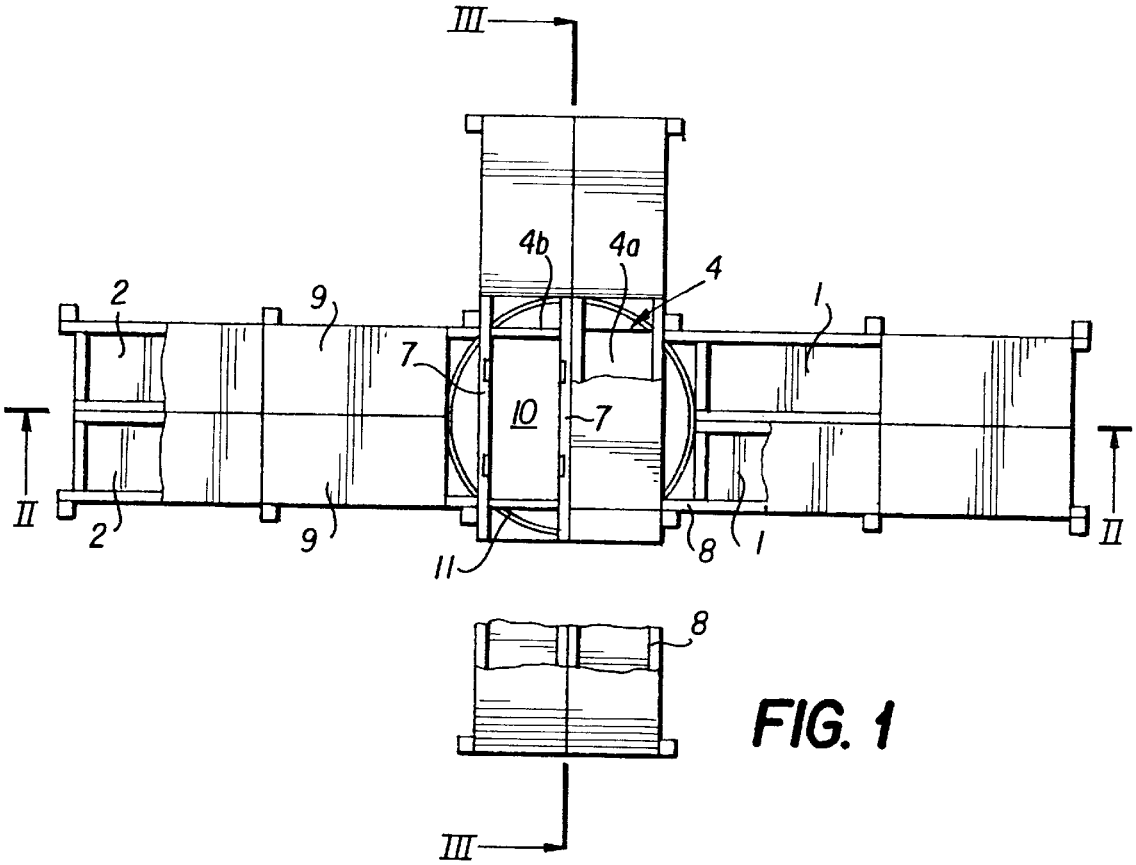
FIG. 1 is a schematic representation in plan view of the facility according to the invention.

Referring to FIG. 1, the multitier parking lot according to this invention comprise a main and additional parking platforms 1, 2, respectively, located on each tier. An intertier elevator 3 delivers a vehicle to a required tier. The elevator has in its upper portion a load-receiving platform 4.

Optionally, additional parking platforms 2 may be omitted. Load-receiving platform 4 is divided into two sections, 4-*a* and 4-*b*. The lower portion of elevator 3 is secured on turntable 5 and fitted with drive 6. Turntable 5 is provided for changing the direction of vehicle movement while placing them on parking platforms 1 and 2, or for removing them from these platforms. Each of platforms 1 and 2, as well as sections 4-*a* and 4-*b* are generally of rectangular shape having side lengths at a ratio of 2:1 to approximate the shape of a vehicle being handled. Two main parking platforms 1 adjoin with its short sides to each of the sides of load-receiving platforms 4 over its entire length, and the said parking platforms 1 adjoin each two adjacent sides of load-receiving platform 4 from inter-perpendicular directions.

Additional parking platforms 2 with their short sides adjoin free short sides of main parking platforms 1. Horizontal guides 7 are installed on each of sections 4-*a* and 4-*b*. At certain turn angles of turntable 5, the guides 7 coincide with horizontal guides 8, installed on parking platforms 1 and 2. Each of platforms 1, 2 carries its bottom plate 9 for a vehicle. Each of sections 4-*a* and 4-*b* carries truck 10 installed in guides 7. The truck is fitted with the bottom plate hoist unit (not shown). Guides 7 and 8 together with trucks 10 form a facility for horizontal movements of vehicles from load-receiving platform 4 to parking platforms 1 and 2 and vice versa. One of the tiers on one side of load-receiving platform 4 carries pit 11 for installing bottom plate 9. The pit 11 is intended for receiving vehicles to the facility and delivering from it.

There are other embodiments for carrying out the present invention. For example, other known means for horizontally moving vehicles, or, other devices for changing the directions of these movements can be used in the facility of the present invention. Also, vehicles in the facility can be placed directly on parking platforms without using bottom plates, etc.

Figure 4:
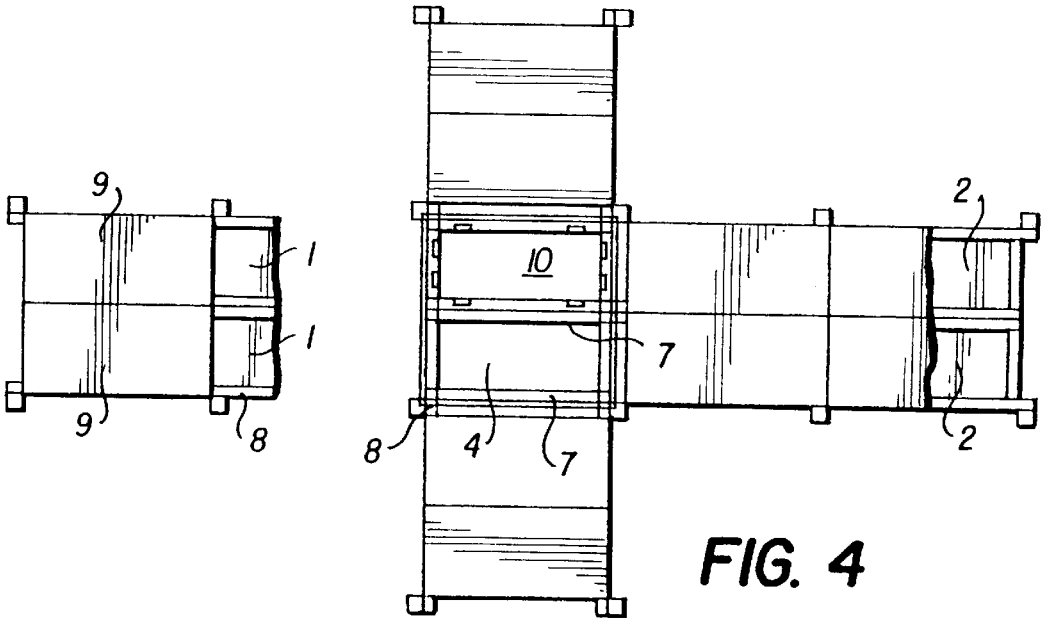
FIG. 4 is another embodiment of the facility wherein all parking platforms are similarly oriented.

FIG. 4 shows another embodiment of the present facility wherein, in contrast to the design described above, turntable 5 is absent. All parking platforms 1 and 2 are oriented in the same way. Horizontal guides 7 are installed in inter-perpendicular directions. The facility contains a truck 10 with the unit (not shown) for setting its wheels in inter-perpendicular directions. This design makes it possible to use parking platforms with side length ratios other than 2:1. There are other means of locating additional platforms 2 between the pair of main platforms 1. In this case, on platforms 1, through which the said platforms 2 communicate with the load-receiving platform, guides 8 are also installed in inter-perpendicular directions.

Figure 2:
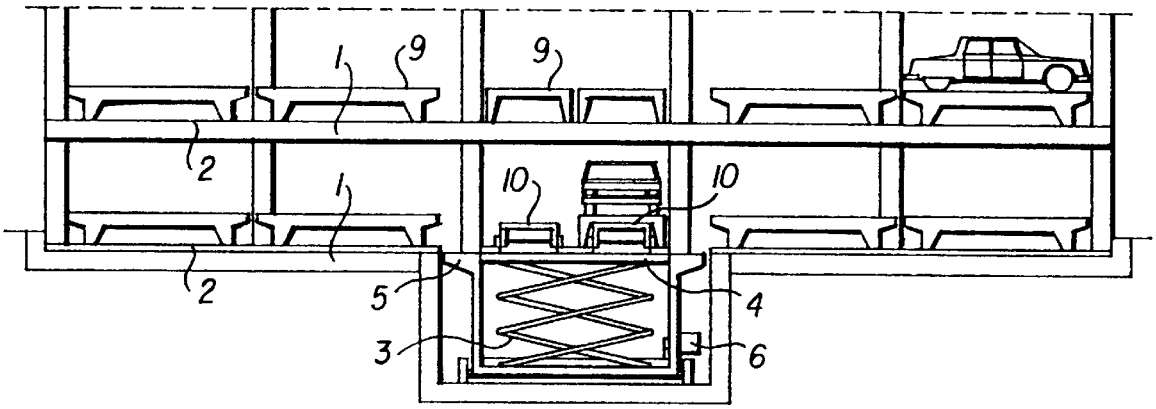
FIG. 2 is an elevational sectional view taken along section II—II in FIG. 1.
Figure 3:
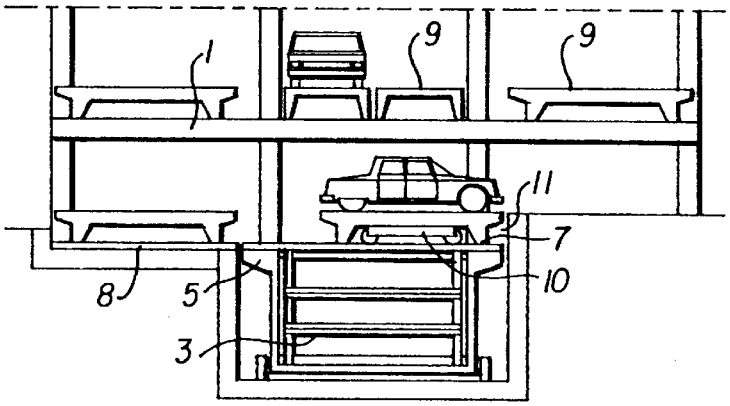
FIG. 3 is an elevational sectional view taken along section III—III in FIG. 1.

The facility shown in FIGS. 1–3 works in the following way. A vehicle to be parked is placed on one of bottom plates 9, installed in pit 11 and moved to one of sections 4-*a* and 4-*b* of load-receiving platform 4 with the aid of truck 10. The truck with the vehicle are elevated to the desired tier with the aid of elevator 3. Then turntable 5 is turned to such a angle, at which guide 7 of load-receiving platform 4 coincides with guide 8 of the parking platform on which the vehicle is to be placed. With the aid of truck 10, the vehicle with the bottom plate is moved to the parking platform, removed from the truck and left on the parking platform. The delivery of the vehicle from the parking facility is performed in a reverse order.

In the case when there is need to move a vehicle located on one of the sections, i.e., 4-*a*, of the load-receiving platform to additional parking platform 2, and all main parking platforms 1 are occupied and, due to this, the possibility of delivering a vehicle through one of them is ruled out, a parked vehicle is temporarily transferred from one parking platform 1 to unoccupied section 4-*b*. Then turntable 5 is turned through the angle of 180° until the coincidence of guides 7 on section 4-*a* with guides 8 on emptied platform 1, the vehicle to be parked is moved through this platform to additional parking platform 2, after which the turntable is turned through 180° and the parked vehicle is moved back to its initial place.

In the embodiment presented in FIG. 4, all horizontal movements of a vehicle and the changes in the directions of these movements for placing the vehicles on a required parking platform, are realized with the aid of one truck 10. This is achieved due to the availability of mutually perpendicular guides and the unit of truck wheel setting in the inter-perpendicular directions. In all the rest, the work of this design is similar to that of the facility described above.

The multitier facility according to the present invention results in a considerable decrease in the equipment expenses per parking place and at the same time raises the efficiency of the facility area utilization in comparison with known designs.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A multi-tier parking lot for vehicles, comprising:

an elevator, movable in an elevator well, to deliver the vehicles to a required tier, the elevator including a rectangular load-receiving platform having more than one position;

each tier including at least one rectangular parking extension adjoining the elevator well from perpendicular directions;

each extension comprising a plurality of rectangular parking platforms further including main parking platforms and additional parking platforms, the main parking platforms communicating with the load-receiving platform;

the additional parking platforms communicating for vehicle movement with the load-receiving platform through the main parking platforms;

an autonomous device for horizontal movements of the vehicles to place the vehicles on and remove the vehicles from the parking platforms;

wherein the load-receiving platform includes two adjacent sections, each of the sections being intended for placing one of the vehicles thereupon, and wherein the load-receiving platform is rotatable and at least in one position of the load-receiving platform, the two adjacent sections are parallel to the main parking platforms;

wherein the autonomous device for horizontal movements of the vehicles is a driven truck including wheels set to provide truck movement in both of the mutually perpendicular positions.

2. The parking lot according to claim 1, wherein the parking platforms include a length-to-width ratio of approximately 2:1.

3. The parking lot according to claim 1, wherein:

the load-receiving platform is orientable on a turntable and is limited to a square area inscribed within the turntable; and each of the sections of the load-receiving platform is disposed within one of the rectangular half of the square area.

4. The parking lot according to claim 3, wherein the parking platforms include a length-to-width ratio of approximately 2:1.

5. The parking lot according to claim 1 wherein:

two main parking platforms adjoin to one side of the load-receiving platform, and one main parking platform adjoins another side of the load-receiving platform, adjacent to the first one; and all parking platforms and sections of the load-receiving platform are oriented similarly.

6. The parking lot according to claim 1, wherein, the elevator well has four parking extensions on each tier forming a cross-shaped structure.

7. The parking lot according to claim 1, wherein, the main parking platforms comprise two adjacent main parking sections, with each main parking section in communication with one of the two load-receiving parking sections.

* * * * *